United States Patent [19]

Berney

[11] 4,345,320

[45] Aug. 17, 1982

[54] INTEGRATED CIRCUIT FOR A TIME-PIECE

[75] Inventor: Jean-Claude Berney, Epalinges, Switzerland

[73] Assignee: Jean-Claude Berney SA, Epalinges, Switzerland

[21] Appl. No.: 135,742

[22] Filed: Mar. 31, 1980

Related U.S. Application Data

[63] Continuation of Ser. No. 881,150, Feb. 24, 1978, abandoned.

[30] Foreign Application Priority Data

Feb. 28, 1977 [CH] Switzerland ..... 2461/77

[51] Int. Cl.[3] ..... G04C 19/00; G04C 9/00

[52] U.S. Cl. ..... 368/87; 368/187

[58] Field of Search ..... 368/85, 87, 155–160, 368/185–188, 200–202, 204; 307/223 R, 304

[56] References Cited

U.S. PATENT DOCUMENTS

| | | | |
|---|---|---|---|
| 3,712,995 | 1/1973 | Stuedel | 307/304 |
| 3,812,669 | 5/1974 | Wiget et al. | 368/201 |
| 3,895,486 | 7/1975 | Hammer et al. | 368/201 |
| 3,916,612 | 11/1975 | Merokala et al. | 368/201 |
| 3,945,194 | 3/1976 | Gollinger | 368/156 |
| 4,055,945 | 11/1977 | Schwarlschild et al. | 368/201 |
| 4,092,820 | 6/1978 | Kume et al. | 368/76 |
| 4,093,873 | 6/1978 | Vannier et al. | 307/223 |
| 4,199,726 | 4/1980 | Bukoske et al. | 368/200 |
| 4,254,494 | 3/1981 | Maeda | 368/201 |

OTHER PUBLICATIONS

*Basic Digital Electronics,* Rat Ryan, 1975, pp. 146–149.

*Primary Examiner*—Vit W. Miska

*Attorney, Agent, or Firm*—Wender, Murase & White

[57] ABSTRACT

An integrated circuit for a time-piece including an oscillator, a frequency divider, an electronic circuit for effecting at least one auxiliary function depending on information delivered to the inputs thereof, a circuit for controlling a display and a circuit for setting the time. The integrated circuit is provided with a first group of terminals for enabling connection of the integrated circuit with external components such as a piezo-electric resonator, the display, and the time-setting circuit.

3 Claims, 5 Drawing Figures

Display Control Circuit
H'
TIME
G'
Correcting & Setting Cir.
Frequency Divider
B'
C'
D'
E'
Pulse Generator
d18
FF
d11
d12
d13
d14
d15
d16
d17
c11
Oscillator
A'
Q'
P'
r40
I3
I4
21
22
23
24
25
26
27
28
29
30
31
32
33
34
35
36
37
38
39
40

Display Control Circuit
H"
Time
G"
Correcting & Setting Cir.
Frequency Divider
B"
C"
D"
E"
Pulse Generator
d28
FF
d21
d22
d23
d24
d25
d26
R S
c21
d27
Oscillator
A"
Q"
P"
T
I5
I6
41
42
43
44
45
64
65
66
67
68
69
70
71

INTEGRATED CIRCUIT FOR A TIME-PIECE

This is a continuation of application Ser. No. 881,150, filed Feb. 24, 1978, now abandoned.

BACKGROUND OF THE INVENTION

The present invention relates to an integrated circuit for a time-piece including a plurality of electronic circuits, particularly an oscillator, a frequency divider, electronic means for effecting at least one auxiliary function depending on information delivered to the inputs thereof, a circuit for controlling display means and a circuit for setting the time, the said integrated circuit being provided with a first group of x terminals for connecting the components of the said time-piece external to the said integrated circuit, such as the piezoelectric resonator, the display means and the time-setting means, to corresponding points of the said electronic circuits.

The great majority of electronic time-pieces use quartz oscillators as time base. These oscillators deliver rather high frequency pulses, for example 32 kHz, which are very stable, to a frequency divider which, in turn, drives the circuit controlling display of the time.

The exact frequency setting operations of quartz crystals are long and delicate and noticeably increase the price of these components.

Various systems have been proposed which permit the use of quartz crystals that have not undergone these frequency setting operations, i.e. of quartz, the frequency of which is different from the theoretically necessary frequency.

These systems comprise a circuit adjusting the frequency of the output signals of the divider which acts, as the case may be, by pre-selecting the rate of division of the divider, or by adding or suppressing some pulses at the input of one or more stages of the divider at pre-determined intervals of time.

Whatever the proposed system may be, means must be available to introduce the necessary information for the programming of the adjustment circuit, so that it can act on the divider circuit in such manner that the divider circuit delivers signals at the desired frequency.

One of the simplest means consists in using terminals of the integrated circuit, including all the circuits of the watch, said terminals being reserved for this purpose. By connecting each of these terminals to one pole or the other of the power supply, binary information may be composed that can be used directly by the adjustment circuit. Hence it is possible to introduce with n terminals $2^n$ separate sets of information. In order to introduce 256 sets of information, it is therefore necessary to reserve 8 terminals. It is known that the terminals of an integrated circuit are a possible source of failure and participate to a not inconsiderable extend in the cost price and dimensions of the integrated circuit. This system, although simple, is therefore not economical.

In order to avoid this large number of terminals, it would be possible to use a ROM memory formed by a combination of interconnections internal to the integrated circuit, selected at the time said circuit is manufactured. Unfortunately, this solution is inflexible for it is necessary to provide as many variants as separate sets of information are desired, 256 with reference to the preceding example.

Another solution resides in using RAM, PROM, REPROM memories and the like. These memories may be programmed at least once by using an addressing circuit within the integrated circuit, thus making it possible to locate the memory position it is desired to programme. Hence, by means of n inputs, it is possible to address and programme $2^n$ memory positions, enabling 2 ($2^n$) separate sets of information to be obtained. In order to introduce 256 sets of information, it is therefore necessary to reserve 3 terminals on the integrated circuit. These systems are therefore advantageous from the point of view of the number of supplementary terminals of the circuit, but at present they all have serious disadvantages for application to a watch. The RAM's, for example, lose their information at the moment the power supply is removed, for example, at the moment when the battery of the watch is changed. As to the PROM's and REPROM's, they require either strong currents, or high voltages for programming, a feature which is difficult to obtain in an integrated circuit for a watch, using technology with a low voltage and a weak current.

SUMMARY OF THE INVENTION

The object of the present invention is an integrated circuit which, by a special arrangement of the addressing circuits and memory components, makes it possible to avoid these difficulties and requires very few additional terminals of the integrated circuit.

According to the present invention there is provided an integrated circuit for a time-piece, including a plurality of electronic circuits, in particular an oscillator, a frequency divider, electronic means for effecting at least one auxiliary function depending on information delivered to its inputs, a display means control circuit and a time-setting circuit, the said integrated circuit being provided with a first group of x terminals for connection of the components of the said time-piece external to the said integrated circuit, such as the piezoelectric resonator, the display means and the time-setting means, to corresponding points of the said electronic circuits, comprising a second group of y terminals in which, as the case may be, terminals for connection of the power supply are incorporated, and n memory circuits connected to at least one of the x terminals of the first group and to at least one of the y terminals of the second group, each of these n memory circuits comprising a memory component associated with addressing means arranged so as to locate and programme the said memory component when there is applied, by means external to the integrated circuit, between the terminals of the first and second groups to which this memory circuit is connected, a particular combination of voltages, and said n memory circuits being also connected to the said electronic means arranged so as to present at their outputs separate information for each of the $2^n$ combinations of possible states delivered to their inputs by n memory circuits.

BRIEF DESCRIPTION OF THE DRAWINGS

The present invention will be described further, by way of example, with reference to the accompanying drawings, in which.

DESCRIPTION OF THE PREFERRED EMBODIMENTS

Figure 1:
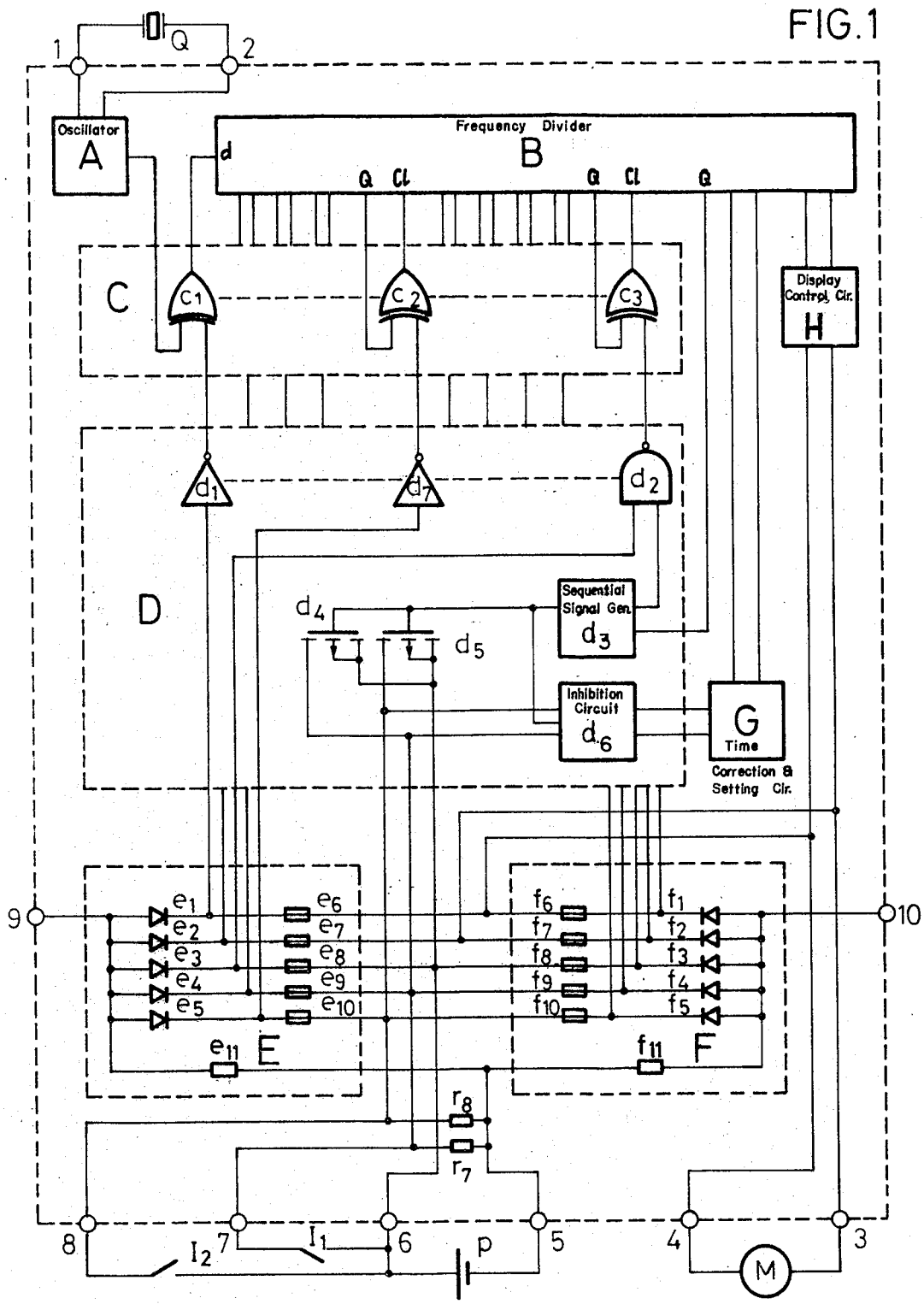
FIG. 1 is a block diagram of an integrated circuit according to the present invention for a watch having an analog display.

FIG. 1 shows, by way of example, a block diagram of an integrated circuit including a plurality of electronic circuits comprising an oscillator A, a frequency divider B, formed of several division stages, an adjusting circuit C, an introduction and identification circuit D, memory circuits grouped under E and F, a circuit H for controlling the display and a circuit G for correction and time setting. These circuits are formed by a plurality of transistors connected together by a plurality of connections in order to obtain the desired functions. To simplify matters, we have shown only the functions and connections necessary for a clear understanding of the invention. The integrated circuit is provided with a first group of terminals 1 to 8, for connecting the electronic circuits to components of the watch outside the integrated circuit. The resonator Q, is connected to the oscillator A by the terminals 1 and 2, the motor driving the hand M is connected to the control circuit H by the terminals 3 and 4, the power supply P is connected to the circuits by the terminals 5 and 6, the switches $I_1$, $I_2$ for correction and time setting are connected to the identification circuit D by the terminals 7 and 8.

The integrated circuit is provided with a second group of terminals 9 and 10, the potential of which is fixed by the resistors $e_{11}$ and $f_{11}$ connected to the negative pole of the power supply P by the terminal 5.

The group E comprises five memory circuits each formed of a diode in series with a fuse. Each of these memory circuits is connected, by the anode of its diode, to the terminal 9, and, by the outer terminal of its fuse, to one of the first group of terminals, the cathode of each diode being connected to an input of the circuit D. The memory circuit formed by the diode $e_1$ and the fuse $e_6$ is connected to the terminal 4, the circuit formed by $e_2$ and $e_7$ is connected to the terminal 3, the circuit formed by $e_3$ and $e_8$ is connected to the terminal 6, the circuit formed by $e_4$ and $e_9$ is connected to the terminal 7 and the circuit formed by $e_5$ and $e_{10}$ is connected to the terminal 8.

The group F comprises also five memory circuits each formed of a diode in series with a fuse. Each of these memory circuits is connected, by the anode of its diode, to the terminal 10, and, by the outer terminal of its fuse, to one of the first group of terminals. the cathode of each diode being connected to an input of the circuit D. The memory circuit formed of the diode $f_1$ and the fuse $f_6$ is connected to the terminal 4, the circuit formed of $f_2$ and $f_7$ is connected to the terminal 3, the circuit formed of $f_3$ and $f_8$ is connected to the terminal 6, the circuit formed of $f_4$ and $f_9$ is connected to the terminal 7 and the circuit formed of $f_5$ and $f_{10}$ is connected to the terminal 8.

The ten memory circuits are therefore each connected to one of the first group of terminals 1 to 8 and, on the other hand, to one of the terminals of the second group 9 and 10, according to ten different combinations of connections. The fuses $e_6$ to $e_{10}$ and $f_6$ to $f_{10}$ are special metallisations of the integrated circuit which can be destroyed by passing a current of a certain strength through them. These fuses are therefore memory components which may have two separate states: a low resistance when they are intact and an infinite resistance when they are destroyed. The diodes $e_1$ to $e_5$ and $f_1$ to $f_5$ are the addressing means of these memory components. In fact, when the integrated circuit is fed by the power supply P, their anodes are on the negative pole and they cannot conduct, whatever the signal delivered by the electronic circuit to the first group of terminals. In order to make a diode conductive, it is necessary to apply a positive voltage between the terminals of the first and second groups to which the particular memory circuit is connected. If, for example, it is desired to destroy the fuse $e_6$, it is necessary to apply a potential 0 to the terminal 4 and a potential +V to the terminal 9. If it is not desired to destroy other fuses, it is also necessary to fix the potential of the other terminals and put 0 on the terminals 5 and 10, and +V to the terminals 3, 6, 7 and 8. Hence only the diode $e_1$ will be conductive and a current will flow from the terminal 9, which is at +V to the terminal 4 which is at 0, through the diode $e_1$ and the fuse $e_6$. This current is limited only by the conducting characteristics of the diode and may therefore be very high, in any case sufficient to destroy the fuse $e_6$.

Each memory component may therefore be destroyed individually by applying particular combination of voltages between the terminals of the first and second groups. These voltages must be applied to the integrated circuit by a voltage generator having a low internal resistance, external to said circuit. Listed below are the special combination of voltages particular the programming of each memory component:

| bornes (terminals) | 3 | 4 | 5 | 6 | 7 | 8 | 9 | 10 |
|---|---|---|---|---|---|---|---|---|
| $e_6$ | + | − | − | + | + | + | + | − |
| $e_7$ | − | + | − | + | + | + | + | − |
| $e_8$ | + | + | − | − | + | + | + | − |
| $e_9$ | + | + | − | + | − | + | + | − |
| $e_{10}$ | + | + | − | + | + | − | + | − |
| $f_6$ | + | − | − | + | + | + | − | + |
| $f_7$ | − | + | − | + | + | + | − | + |
| $f_8$ | + | + | − | − | + | + | − | + |
| $f_9$ | + | + | − | + | − | + | − | + |
| $f_{10}$ | + | + | − | + | + | − | − | + |

In order to obtain the combinations $e_8$ and $f_8$, it is of course necessary to disconnect the power supply P.

It is also possible, by other voltage combinations, to destroy several fuses simultaneously.

This system has two advantages: on the one hand, it is possible to programme ten memory circuits by using only two additional terminals of the integrated circuit; on the other hand, it is possible to reach directly, through a diode, all the fuses, thus making it possible to feed easily, through an external generator, the high current necessary for the destruction of said fuses.

So that the information provided by the memory components may be used, it is necessary to identify the state of each of them and to introduce into the adjusting circuit C a series of specific logic states. This is the function of the circuit D. This series of logic states depend on the form of circuit C. In this example, this circuit C comprises ten "EXCLUSIVE OR" gates, only part of which is shown. The first gate $c_1$, has its first input connected to the output of the oscillator A and its output connected to the clock input of the first binary division stage of the divider B, and each of the subsequent gates, such as $c_2$ and $c_3$, are connected to the outputs of the nine first binary division stages of the divider B and to the input clock of each subsequent division stage, which gives twenty connections between the circuits A and B and the circuit C. The second inputs of the ten "EXCLUSIVE OR" gates of the circuit C are connected to ten corresponding outputs of circuit D.

It is well known that in an "EXCLUSIVE OR" gate, the signals applied to the first input and the output signals are phase shifted by 180° with each modification of the logic state of the second input. Hence, if pulses of period T are applied to the second input of one of the ten "EXCLUSIVE OR" gates of circuit C, then the average period of the signals delivered by the divider B will be shortened by a relative value ($t \cdot 2^n/T$), t being the output period of the signals delivered by the oscillator A, and n the number of binary division stages between the said oscillator and the input of the "EXCLUSIVE OR" gate concerned. It is therefore possible to adjust the frequency of the signals delivered by the divider B by applying periodic pulses to all or some of the second inputs of the ten "EXCLUSIVE OR" gates of the circuit C. To avoid any ambiguity, it is desirable that the rising and falling edges of these pulses should be controlled by one of the division stages of the circuit B which follows the "EXCLUSIVE OR" gate to which these pulses are applied.

It is the function of circuit D to apply pulses of this nature to the corresponding inputs of circuit C according to the combination determined by the state of the memory components. We shall examine hereinafter three significative cases.

The memory components (fuses) $e_6$, $e_7$, $f_6$ and $f_7$ are connected to outputs of the circuit H controlling the display means. The circuit H is controlled by outputs of the divider B which determine the period and the duration of the driving pulses delivered by this circuit H to the motor M via the terminals 3 and 4. Let us examine the cases of the memory circuit formed of the diode $e_1$ and the fuse $e_6$.

If the $e_6$ is intact, driving pulses delivered by the circuit H to the terminal 4 are transmitted by the fuse $e_6$ to the cathode of $e_1$ and to the input of an amplifier $d_1$. The output of $d_1$ is connected to the second input of the "EXCLUSIVE OR" gate $c_1$. The gate $c_1$ will therefore receive pulses directly issuing from the driving pulses, the rising and falling edges of which are controlled by signals delivered by the divider B, thus involving a corresponding adjustment of the frequency of these signals.

If the fuse $e_6$ is destroyed, the potential of the cathode of $e_1$ is fixed at 0 by the leakage current of $e_1$ and by the resistor $e_{11}$ connected to the terminal 5. The output of the amplifier $d_1$ remains permanently at 1 and the "EXCLUSIVE OR" gate $c_1$ remains inoperative and there is no adjustment of the frequency of the signals delivered by the divider B. The fuses $e_7$, $f_6$ and $f_7$ are connected in the same manner to amplifiers (not shown), of the circuit D, the outputs of which are connected to inputs of "EXCLUSIVE OR" gates of the circuit C.

The memory components $e_8$ and $f_8$ are connected to the positive pole of the power supply P by the terminal 6. Let us examine the case of the memory circuit formed of the diode $e_3$ and the fuse $e_8$.

If the fuse $e_8$ is intact, the potential on the cathode of $e_3$ is fixed at 1 (+V). This cathode is connected to the first input of a NAND gate $d_2$, the output of which is connected to the second input of the "EXCLUSIVE OR" gate $c_3$, and the second input of gate $d_2$ is connected to an output of a sequential signal generator $d_3$. The duration and the period of the signals delivered by generator $d_3$ are controlled by outputs of the divider B. As the first input of $d_2$ is at 1, these sequential signals appear on the second input of $c_3$, thus involving a corresponding adjustment of the frequency of the output signals of the divider B.

If the fuse $e_8$ is destroyed, the potential on the cathode of $e_3$ and the first input of $d_2$ is fixed at 0 by the reverse current of $e_3$ and the resistor $e_{11}$. The output of the gate $d_2$ will therefore be maintained at 1 and the "EXCLUSIVE OR" gate $c_3$ will remain inoperative.

The fuse $f_8$ is connected in the same manner to a NAND gate of the circuit D, the output of which is connected to the second input of an "EXCLUSIVE OR" gate of the circuit C (not shown).

The memory components $e_9$, $e_{10}$, $f_9$ and $f_{10}$ are connected to one of the terminals 7 or 8, the potential of which is fixed at 0 by the resistor $r_7$ or $r_8$ respectively, except occasionally when the time setting circuit switches $I_1$ and $I_2$ are manipulated. As these memory components are already connected to 0 by the leakage current of their diode and the resistor $e_{11}$ or $f_{11}$ respectively, it is necessary to superimpose on the resistors $r_7$ and $r_8$ identification signals to determine the state of the memory components. Hence, $r_7$ is connected to the drain of a MOS transistor $d_4$ and $r_8$ to the drain of a MOS transistor $d_5$. These transistors $d_4$ and $d_5$ have their source at +V and their gate connected to an output of the sequential signal generator $d_3$. They act as electronic switches and make it possible to superimpose positive pulses of short duration, on the resistors $r_7$ and $r_8$. The output of $d_3$ and the drains of $d_4$ and $d_5$ are further connected to the inputs of an inhibition circuit $d_6$, the output of which are connected to the time setting circuit G. The identification pulses act on the memory circuits in the same manner as the driving pulses in the first discussed case. Let us examine the case of the memory circuit formed of the fuse $e_{10}$ and the diode $e_5$.

If $e_{10}$ is intact, the identification pulses pass through $e_{10}$ to the cathode of $e_5$ and to the input of the amplifier $d_7$ and from there to the second input of the "EXCLUSIVE OR" gate $c_2$ and cause a corresponding adjustment of the frequency of the signals delivered by the divider B. If $e_{10}$ is destroyed, the potential at the input of $d_7$ is fixed at 0 by the reverse current of the diode $e_5$ and by the resistor $e_{11}$. The output of $d_7$ is at 1 and $c_2$ is inoperative.

The fuses $e_9$, $f_9$ and $f_{10}$ are connected in the same manner by amplifiers of the circuit D to "EXCLUSIVE OR" gates of the circuit C (not shown).

The circuit breakers $I_1$ and $I_2$ are used for re-setting the time-piece. They permit, according to their open or closed state, the introduction of logic states 0 and 1 at the inputs of the inhibition circuit $d_6$, these states being transmitted by this circuit $d_6$ to the time setting circuit G, itself acting on the frequency divider B. The object of this inhibition circuit is to make the identification pulses inoperative on the time setting circuit G, which must register only the instructions coming from the setting switches.

It is therefore possible to programme the adjustment circuit C by means of the introduction and identification circuit D as a function of the state of the memory components, in this case, fuses.

In our case there are $2^{10}$ different combination of these states, thus making it possible to obtain 1024 adjustment steps.

If the period of the signals delivered by the circuits H and $d_3$ 5.

In order not to excessively shorten the driving pulses, it is desirable that the sequential signals delivered by the generator $d_3$ are not produced during the duration of the driving pulses.

It would be also possible to increase the capacity of the adjustment circuit by connecting memory circuits between the terminals 1 and 2 and the terminals 9 and 10 as long as input of the oscillator A passes through predetermined logic states, a feature which depends on the configuration of this oscillator.

Figure 2:
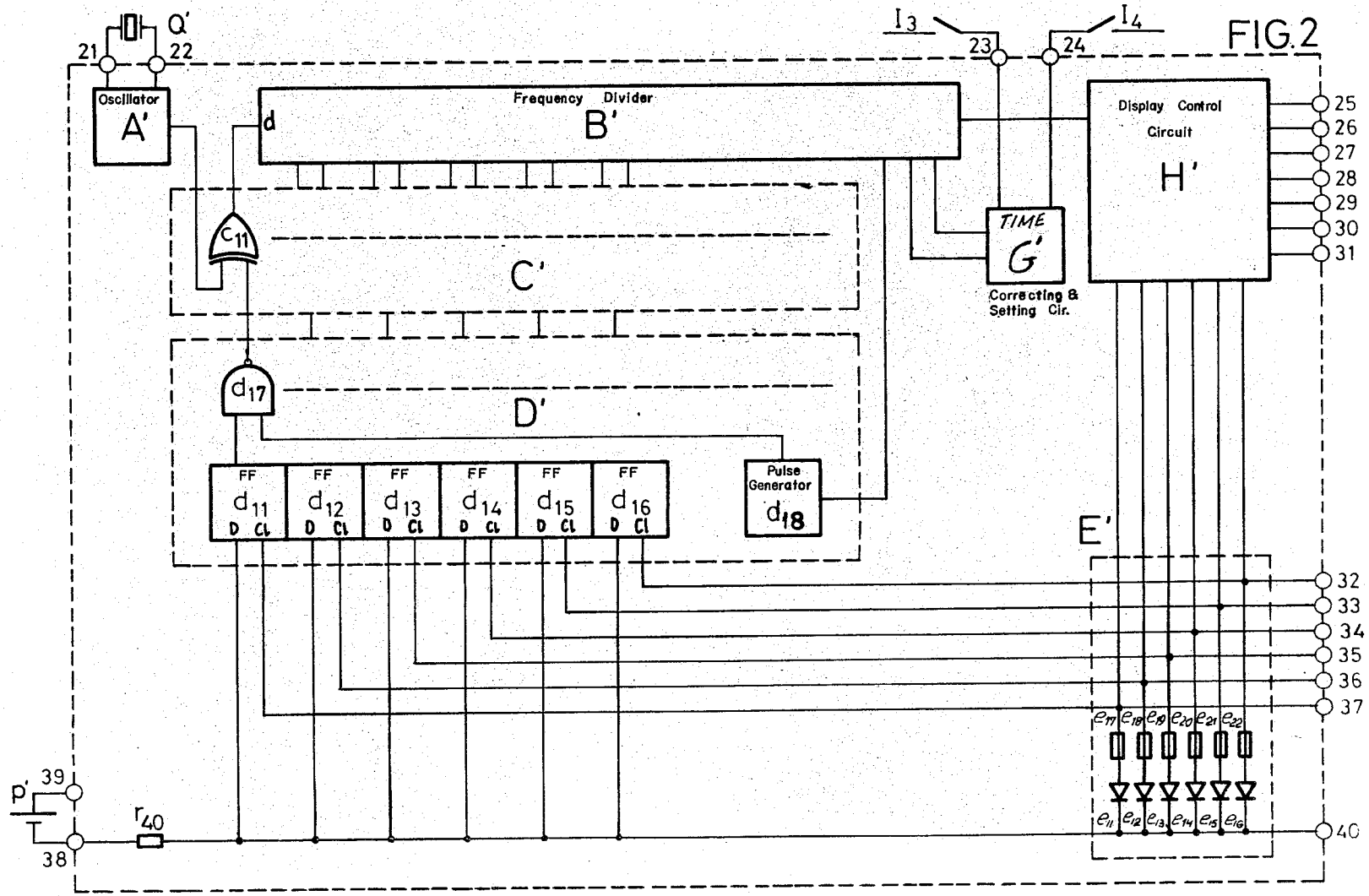
FIG. 2 is a block diagram of an integrated circuit according to the invention for a watch having a digital display with light emitting diode (LED)

FIG. 2 shows, by way of example, the block diagram of an integrated circuit according to the invention, intended for a watch with digital display having light emitting diodes (LED). This integrated circuit includes a plurality of electronic circuits, the oscillator A', the frequency divider B', the adjustment circuit C', the introduction and identification circuit D', the memory circuits grouped under E', the circuit H' controlling the display means and the time correction and setting circuit G'. The integrated circuit is provided with a first group of terminals 21 to 39 for connecting the electronic circuit to components of the watch external to the integrated circuit, such as the quartz crystal Q', by the terminals 21 and 22, the correction and time setting switches $I_3$ and $I_4$ by the terminals 23 and 24 and the power supply P' by the terminals 38 and 39. The LED display is multiplexed. It is connected to the seven output segments of the circuit H' by the terminals 25 to 31, and to the six output digits of the same circuit by the terminals 32 to 37.

The integrated circuit also comprises an additional terminal 40, the potential of which is fixed at 0 by the resistor $r_{40}$.

The group E' comprises six memory circuits, each formed, as in FIG. 1, by a diode in series with a fuse. Each of these memory circuits is connected by the cathode of its diode to the circuit D' and to the terminal 40, and to one of the first group of terminals. The memory circuit formed by the diode $e_{11}$ and the fuse $e_{17}$ is connected to the terminal 37, the circuit formed by $e_{12}$ and $e_{18}$ is connected to the terminal 36, the circuit formed by $e_{13}$ and $e_{19}$ is connected to the terminal 35, the circuit formed by $e_{14}$ and $e_{20}$ is connected to the terminal 34, the circuit formed by $e_{15}$ and $e_{21}$ is connected to the terminal 33, and the circuit formed by $e_{16}$ and $e_{22}$ is connected to the terminal 32. If the resistor $r_{40}$ is of high value, it is necessary, in order to destroy the fuse $e_{17}$, to apply a voltage +V to the terminal 37 and a voltage 0 to the terminal 40 by means of an external voltage generator having a low internal resistance. At this moment the current is no longer limited except by the conduction characteristics of the diode $e_{11}$ and the current may be very strong, in any case sufficient to destroy the fuse $e_{17}$. As in the case of FIG. 1, all the fuses $e_{17}$ to $e_{22}$ may be destroyed separately by applying various voltage combinations between the first and second groups of terminals.

The circuit D' comprises its own memorising circuits in which the states of the fuses are transposed. This comprises six D flip-flops $d_{11}$ to $d_{16}$, the D inputs of which are connected to the terminal 40 and the clock input to each of the terminals 32 to 37.

It is well known that, in a multiplexed display, the digits are fed in turn. Therefore, positive pulses appear in turn on the terminals 32 to 37. Let us examine the case of the memory circuit formed of the diode $e_{11}$ and the fuse $e_{17}$ connected to the terminal 37 and also to the clock input of the FF $d_{11}$, which is arranged to change state on the negative edge of the clock pulse.

If the fuse $e_{17}$ is intact, the potential at the terminal 40, and also at the D input of FF $d_{11}$, will be 1 during the positive pulse appearing on the terminal 37 due to the current circulating through $e_{17}$ and $e_{11}$. When this pulse disappears, this state 1 will be registered by FF $d_{11}$.

If the fuse $e_{17}$ is destroyed, the potential on the terminal 40 will be fixed at 0 during this positive pulse on the terminal 37, since the current can no longer circulate through $e_{17}$. This state 0 will be registered by FF $d_{11}$ when the pulse disappears.

The output of $d_{11}$ will therefore be 1 if the fuse $e_{17}$ is intact, and at 0 if this fuse is destroyed. This output is connected to the first input of a NAND gate $d_{17}$, the second input of which is connected to the output of a pulse generator $d_{18}$, connected to output of the frequency divider B'. The output of $d_{17}$ is connected to the second input of an "EXCLUSIVE OR" $c_{11}$, the first input of which is connected to the output of the oscillator A'and the output of which is connected to the clock input of the first division stage of the divider B'.

When the output of FF $d_{11}$ is 1, the gate $d_{17}$ is open and the pulses of the generator $d_{18}$ are transmitted to the second input of gate $c_{11}$, thus causing a corresponding adjustment of the frequency of the signals delivered by the frequency divider B'. If, on the other hand, the output of FF $d_{11}$ is 0, the gate $d_{17}$ is blocked and the gate $c_{11}$ remains inoperative. The flip-flops $d_{12}$ to $d_{16}$ act in the same manner through NAND gates of the circuit D' and "EXCLUSIVE OR" gates of the circuit C' (not shown). The outputs of FF $d_{11}$ to $d_{16}$ may present $2^6$ different combinations of states, which correspond to the $2^6$ combinations of states of the fuses $e_{17}$ to $e_{22}$, thus permitting 64 adjustment steps. The number of these steps may be easily increased by employing other outputs of the first group, or by adding other additional outputs to the second group.

Figure 3:
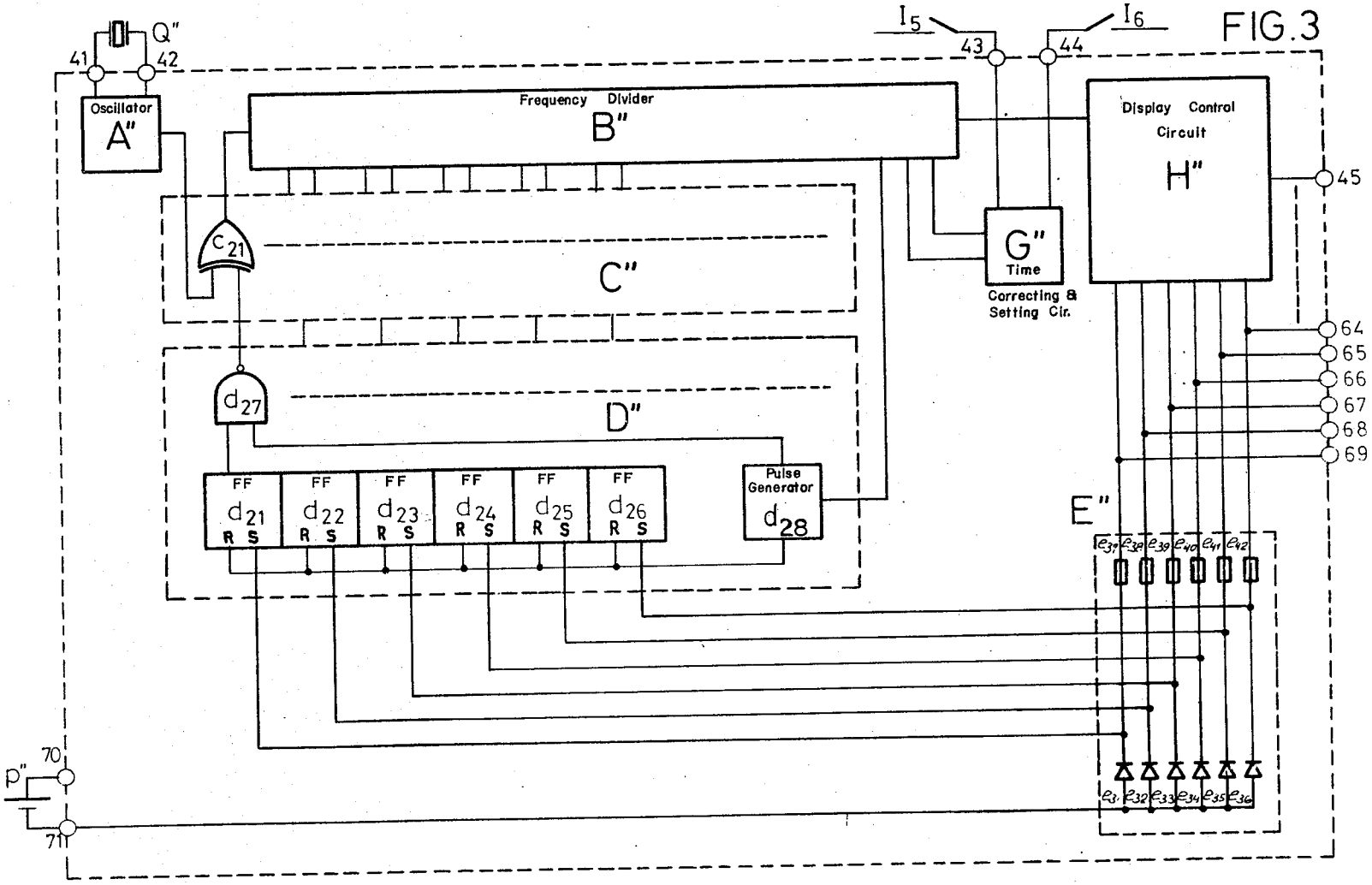
FIG. 3 is a block diagram of an integrated circuit for a watch having a liquid crystal digital display (LCD)

FIG. 3 shows, by way of example, a block diagram of an integrated circuit according to the invention, intended for a watch with liquid crystal digital display (LCD). This integrated circuit includes a plurality of electronic circuits, the oscillator A", the frequency divider B", the adjustment circuit C", the introduction and identification circuit D", the memory circuits grouped under E", the circuit controlling display means H" and the time correcting and setting circuit G". The integrated circuit is provided with a first group of terminals 41 to 71 to connect the electronic circuit to components of the watch which are external to the integrated circuit, such as the quartz crystal Q" by the terminals 41 and 42, the time setting and correcting switches $I_5$ and $I_6$ by the terminals 43 and 44, and the power supply P" by the terminals 70 and 71. The segments and the common electrode of the LCD display are connected to 24 outputs of circuit H" by the terminals 45 to 69.

Terminal 71, used for connecting the negative pole of the power supply, is also used as a programming terminal when the battery is not connected.

The group E" comprises six memory circuits, each formed, as in FIGS. 1 and 2 of a diode in series with a fuse. Each of these memory circuits is connected on one hand by the cathodes of its diode to one of the inputs of the circuit D", and by the anodes of the diodes to terminal 71, and, on the other hand, to one of the first group of terminal 16-69. Specifically, the memory circuit formed by the diode $e_{31}$ and the fuse $e_{37}$ is connected to the terminal 69, the circuit formed by $e_{32}$ and $e_{38}$ is connected to the terminal 68, the circuit formed by $e_{33}$ and $e_{39}$ is connected to the terminal 67, formed by $e_{34}$ and $e_{40}$ is connected to the terminal 66, the circuit formed by $e_{35}$ and $e_{41}$ is connected to the terminal 65, and the circuit formed by $e_{36}$ and $e_{42}$ is connected to the terminal 64. When the battery P" is in position, the anodes of the diodes $e_{31}$ to $e_{36}$ are at 0 and these diodes cannot conduct. But, if the battery is disconnected, it is possible to apply a potential +V to the terminal 71 by means of an external voltage generator. Hence, for example, if it is desired to destroy the fuse $e_{37}$, it is necessary to apply +V to the terminal 71 and 0 to the terminal 69. A strong current will circulate from the terminal 71 to the terminal 69 through the diode $e_{31}$ and the fuse $e_{37}$, capable of destroying the fuse. As in the cases of FIGS. 1 and 2, it is possible to individually destroy all the fuses $e_{37}$ to $e_{42}$ by applying different voltage combinations between the first and second group of terminals.

The circuit D" comprises its own memorizing means in which the states of the fuses are transposed. These means consist in six RS NOR latches $d_{21}$ to $d_{26}$, the set inputs of which are connected in each case to the cathode of one of the diodes $e_{31}$ to $e_{36}$, and the reset inputs are connected to an output of a pulse shaper $d_{28}$. The pulse shaper $d_{28}$ supplies fine reset pulses at pre-determined moments. It is well known that, in LCD displays, the segments and the common electrode receive squared signals of rather low frequency, for example 32 Hz. Let us examine the case of the memory circuit formed by the diode $e_{31}$ and the fuse $e_{37}$.

If the fuse $e_{37}$ is intact, the 32 Hz signals delivered by the circuit H" to the terminal 69 are transmitted by the fuse $e_{37}$ to the cathode of the diode $e_{31}$ and to the set input of the RS latch $e_{21}$. If the latter has previously been returned to 0 by the reset pulses delivered by the pulse shaper $d_{28}$ it will return to 1 as soon as the signal to the terminal 69 becomes positive again, i.e., a maximum of 15 ms later, and will keep this state 1.

If the fuse $e_{37}$ is destroyed, the potential on the cathode of the diode $e_{31}$ is fixed at 0 by its reverse leakage current. If the RS NOR latch $d_{21}$ has been returned to 0, it will retain this state, since its set input remains at 0.

Latch $d_{21}$ acts in the same manner as $d_{11}$ in FIG. 2 by way of the NAND gate $d_{27}$ and the EXCLUSIVE OR gate $c_{21}$. The second input of $d_{27}$ is connected to a second output of the pulse shaper $d_{28}$ which delivers correction signals arranged so as to be dephased relative to the reset pulses. The output of the RS latches $d_{22}$ to $d_{26}$ are connected by other NAND's to other EXCLUSIVE OR gates (not shown).

It is possible to use, without further consideration, the 24 outputs of the display, which would make it possible to obtain $2^{24}$ adjustment steps. If such a capacity is not required, it is possible to use a portion of the information for the programming of other systems.

Figure 4:
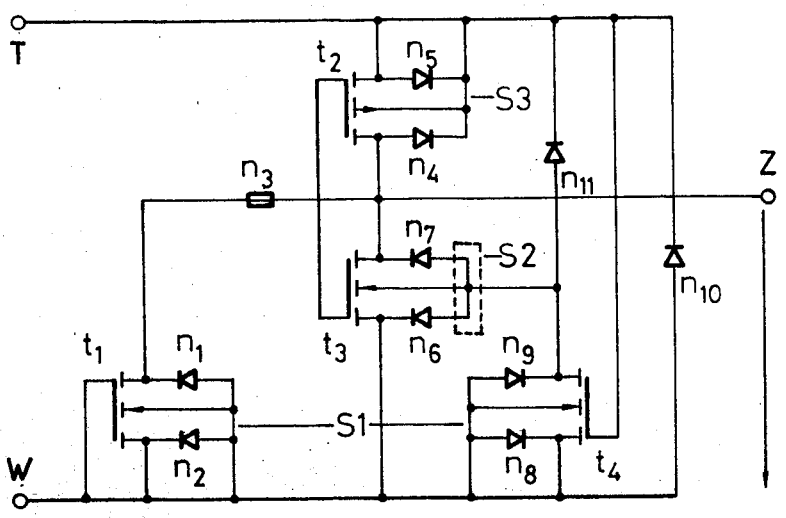
FIG. 4 shows a detail of an integrated circuit in which the parasitic diodes of MOS transistors are used.

FIG. 4 shows by way of example a detail of an integrated circuit according to the invention, obtained by CMOS technology, in which the parasitic diodes of the MOS transistors are used.

It is well known that, in CMOS technology, the base substrate is of N type. The sources and drains of P type transistors are P+ zones diffused directly onto this base substrate. In order to obtain N type transistors, it is necessary to previously form a P type well, and the sources and drains of N type transistors are then diffused into this well. Naturally, parasitic diodes exist between source and the P type well and drain and the P type well, diodes of which the anodes are common to the P type well. It is easy to obtain groups of diodes insulated from each other by producing several P type wells. In FIG. 4 we have shown a memory circuit connected in the same manner as in FIG. 3, and an output amplifier with all the parasitic diodes.

T is the terminal normally connected to the positive pole of the power supply, W the terminal normally connected to the negative pole and Z a terminal connected to the LCD display.

The memory circuit is formed by the diode $n_1$ in series with a fuse $n_3$, $n_1$ being the parasitic diode between the drain of the transistor $t_1$ and the well $S_1$ which is common to the majority of the N type transistors of the integrated circuit. $S_1$ is connected to terminal W. The transistor $t_1$ has its gate and its source both connected to the terminal W and is therefore non-conducting. The source well parasitic diode is $n_2$. The fuse $n_3$ is connected to the terminal Z and to the output of an amplifier formed by the complementary transistors $t_2$ and $t_3$, having their drains and their gates in common, according to a well known configuration. The transistor $t_2$ has two parasitic diodes, $n_4$ and $n_5$ towards the substrate $S_3$ which is common to all the P transistors of the integrated circuit. $S_3$ is connected to the terminal T. The transistor $t_3$ is diffused onto an insulated well $S_2$ with other N transistors of the output amplifiers. It has two parasitic diodes, $n_6$ and $n_7$, towards the well $S_2$. It would naturally have been possible to leave this well $S_2$ floating. It is, however, preferable to fix its potential, which is done by connecting it to the drain of the transistor $t_4$, the source of which is on the terminal W and the gate to the terminal T. Transistor $t_4$ is diffused onto the substrate $S_1$ and has two parasitic diodes $n_8$ and $n_9$ towards this substrate. There are still parasitic diodes $n_{10}$ and $n_{11}$ between the wells $S_1$ and $S_2$ and the substrate $S_3$.

If, in order to destroy the fuse $n_3$, a voltage +V is applied to the terminals T and W, and a voltage 0 to the terminal Z, a first current is circulated from the terminal W to the terminal Z through the diode $n_1$ and the fuse $n_3$, and a second current through the diode $n_9$ and the diode $n_7$. It is possible to proceed in such manner, by correctly dimensioning the diodes $n_1$ and $n_9$, that the first current is clearly stronger than the second, thus making it possible to destroy the fuse $n_3$ without damaging other parts of the circuit.

It will therefore be seen that it is perfectly possible, in an integrated circuit using CMOS technology, to use the parasitic diodes of the MOS transistors as a means of addressing memory circuits.

Figure 5:
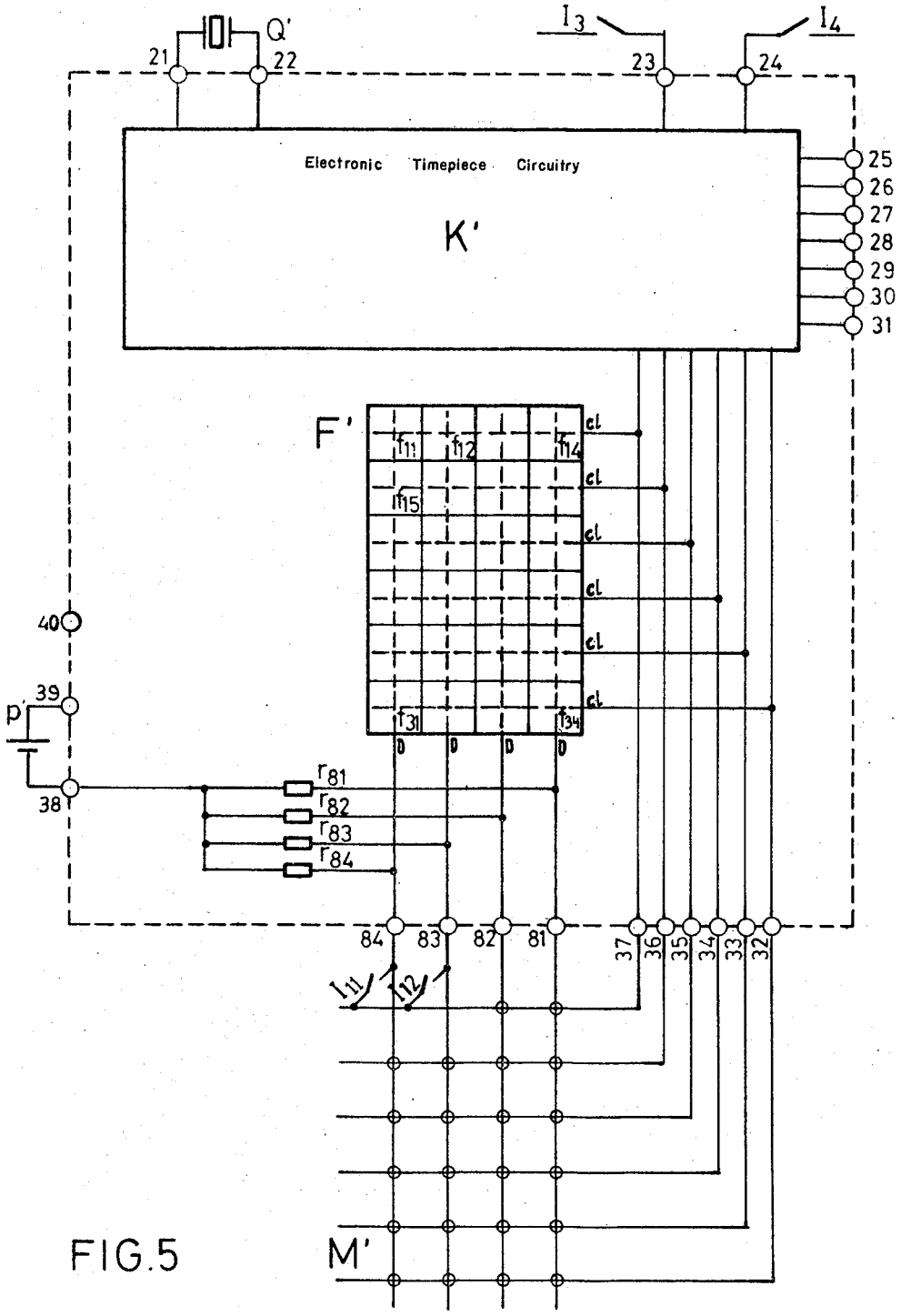
FIG. 5 shows a block diagram of an integrated circuit employing RAM memory circuits.

FIG. 5 shows by way of example an integrated circuit according to the invention using RAM memory circuits.

FIGS. 1 to 4 show integrated circuits fitted with PROM memory components in the form of fuses acting on an adjustment circuit of the frequency of the divider which make it possible to resolve a problem common to all types of electronic watches. By extension, it is possible to use this system to program other types of memory circuits, for example, REPROM's or RAM's, and to use this information for purposes other than the programming of an adjustment circuit. It is evidently not possible to surmount the disadvantage of RAM's which is to lose information when the electric power source is suppressed. But, on the other hand, it is possible to benefit from one characteristic of the system which is to reduce the number of terminals of the integrated circuit. An interesting case is the calculator watch. It is well known that it is possible to add calculating means to a digital watch. These watches are fitted with a keyboard permitting the introduction of numbers and for controlling certain operations, and the integrated circuit thereof is fitted with memory circuits for memorising, at least momentarily, these numbers and these instructions. In FIG. 5 we have shown an integrated circuit for a calculator watch having a LED display with six digits, presenting itself as the integrated circuit of FIG. 2 to which calculating means and some extra terminals have been added.

The integrated circuit is provided with a first group of terminals 21 to 39 to connect, as in the integrated circuit of FIG. 2, the quartz crystal Q', the time-setting switches $I_4$ and $I_3$, the LED display segments and the battery P', the terminals 32 to 37 being each connected to one of the display digits. The integrated circuit is provided with a second group of terminals comprising the terminal 40, for programming the adjustment circuit by means of memory components of PROM type, and the terminals 81 to 84 connected to the negative pole of the battery by the resistors $r_{81}$ to $r_{84}$. The integrated circuit comprises, as in FIG. 2, a plurality of electronic circuits, included in the circuit K', comprising an oscillator, a frequency divider, an adjustment circuit, an introduction and identification circuit, memory circuits, a correction and time-setting circuit, a display means control circuit, to which means calculating circuits are added.

The integrated circuit comprises further 24 RAM memory circuits grouped under F', in the form of D flip-flops arranged in a matrix in six lines and four columns. The four flip-flops of each line have their clock inputs connected in common to one of the terminals 32 to 37. The six flip-flops of each column have their D inputs connected in common to one of the terminals 81 to 84. Hence, each flip-flop is connected, on the one hand, to one of the terminals of the first group and, on the other hand, to one of the terminals of the second group in 24 combinations of different connections.

The watch is fitted with a keyboard M' arranged in a matrix, also comprising six lines, each connected to one of the terminals 32 to 37, and four columns, each connected to one of the terminals 81 to 84, and 24 switches making it possible to short-circuit separately each of the lines with each of the columns. These switches are therefore means external to the integrated circuit, making it possible to establish various voltage combinations between the terminals thereof.

Let us now observe what happens when the switch $I_{11}$ is closed. The pulses present on the terminal 37 will appear on the terminal 84. However, only the flip-flop $f_{11}$ will receive these pulses simultaneously on its clock input and on its D input and will swing to 1, hence, each switch of the keyboard corresponds to a flip-flop of group F' which can therefore locate and memorise the instruction given by the user to transmit it subsequently to the calculating circuits. This system thus makes it possible to economise six line terminals since outputs of LED display are used. It will therefore be seen, that, for this particular case, the use of an integrated circuit according to the invention may also be very advantageous.

What we claim is:

1. An integrated circuit for a timepiece having means responsive to control signals for displaying time data, a power source, and manually actuated time setting elements for producing time setting signals, the integrated circuit comprising:

a first group of terminals including first terminals connecting the displaying means with the integrated circuit, and second terminals connecting the power source and the time setting elements with the integrated circuit;

means for producing a time base signal;

means responsive to said time base signal and to the time setting signals for producing the controls signals, the control signals being applied to said first terminals;

means connected to selected ones of said first terminals and to selected ones of said second terminals for storing a data signal in response to a first predetermined combination of voltages applied simultaneously to said selected first terminals and to said selected second terminals, said data signal being determined by the control signals present at said selected first terminals; and means connected to said storing means for performing an auxiliary function of the timepiece in response to said data signal.

2. An integrated circuit according to claim 1, further comprising a second group of terminals connected to said storing means, said storing means being responsive to a second predetermined combination of voltages applied simultaneously to said selected first terminals, to said selected second terminals and to said second group of terminals for storing said data signal.

3. An integrated circuit according to claim 2, further comprising means for applying sequential signals to said selected second terminals, said data signal of said storing means being determined by the control signals present at said selected first terminals and by said sequential signals.

* * * * *